US008581496B2

(12) United States Patent
Rutberg et al.

(10) Patent No.: US 8,581,496 B2
(45) Date of Patent: Nov. 12, 2013

(54) SELF-IGNITING LONG ARC PLASMA TORCH

(75) Inventors: Alexander Filippovich Rutberg, Madison, AL (US); Philipp Grigorevich Rutberg, Saint Petersburg (RU); Sergei Dmitrievich Popov, Saint Petersburg (RU); Valentin Anatolevich Spodobin, Saint Petersburg (RU)

(73) Assignee: Oaks Plasma, LLC., Austin, TX (US)

( * ) Notice: Subject to any disclaimer, the term of this patent is extended or adjusted under 35 U.S.C. 154(b) by 170 days.

(21) Appl. No.: 13/193,927

(22) Filed: Jul. 29, 2011

(65) Prior Publication Data

US 2013/0026918 A1 Jan. 31, 2013

(51) Int. Cl.
*H05B 31/26* (2006.01)

(52) U.S. Cl.
USPC ..... 315/111.21; 315/111.91

(58) Field of Classification Search
USPC ..... 315/111.21, 111.31, 111.71, 111.91, 315/111.51
See application file for complete search history.

(56) References Cited

U.S. PATENT DOCUMENTS

| | | | | |
|---|---|---|---|---|
| 3,248,513 | A | 4/1966 | Sunnen | |
| 3,541,297 | A | 11/1970 | Sunnet et al. | |
| 3,578,943 | A | 5/1971 | Schoumaker | |
| 3,818,174 | A | 6/1974 | Camacho | |
| 4,517,495 | A | 5/1985 | Piepmeier | |
| 4,549,065 | A | 10/1985 | Camacho | |
| 4,564,740 | A | 1/1986 | Paton et al. | |
| 4,891,490 | A | 1/1990 | Labrot et al. | |
| 5,362,939 | A | 11/1994 | Hanus | |
| 5,880,426 | A | 3/1999 | Fukui et al. | |
| 5,906,757 | A | 5/1999 | Kong et al. | |
| 6,137,231 | A * | 10/2000 | Anders et al. | 315/111.21 |
| 6,362,449 | B1 | 3/2002 | Hadidi et al. | |
| 6,538,388 | B2 * | 3/2003 | Nakano et al. | 315/111.21 |
| 6,670,766 | B2 * | 12/2003 | Yamazaki et al. | 315/111.21 |
| 6,946,617 | B2 | 9/2005 | Brandt et al. | |
| 7,394,041 | B2 * | 7/2008 | Choi | 219/121.36 |
| 7,665,407 | B2 | 2/2010 | Hwang et al. | |
| 2004/0256365 | A1 | 12/2004 | DePetrillo et al. | |
| 2008/0145553 | A1 | 6/2008 | Boulos et al. | |
| 2011/0079506 | A1 | 4/2011 | Blijker et al. | |

* cited by examiner

*Primary Examiner* — Minh D A
(74) *Attorney, Agent, or Firm* — File-EE-Patents.com; Jay A. Chesavage

(57) ABSTRACT

A plasma torch is formed from a hollow electrode forming a first gap to an isolated plasma tube, the isolated plasma tube forming a second gap with a plasma outlet tube having electrically common plasma tubes which terminate into a plasma outlet. The first gap and second gap of the isolated plasma tubes are fed by a source of plasma gas such that when a voltage is applied across the electrodes, plasmas initially form across the first plasma gap and second plasma gap. The formed plasmas spread laterally until the plasmas are formed entirely from electrode to electrode and self-sustaining. Plasma gasses which are fed to the plasma torch can be metered on both sides of the electrodes to steer the plasma arc attachment axially over the extent of the hollow electrodes, thereby reducing surface wear and increasing electrode life.

20 Claims, 6 Drawing Sheets

Plasma Torch

Plasma Tube Cross Section

Axial Arc estimation

Axial arc position control using flow F2

Arc attach angular velocity vs gas flow

Plasma Tube Dimensions

Gas Inlet cross section A–A

SELF-IGNITING LONG ARC PLASMA TORCH

FIELD OF THE INVENTION

The present invention relates to a plasma torch. In particular, the present invention is a multi-phase plasma torch for the generation of a plasma arc in excess of 0.3 meter (m) length which includes structures for the automatic initiation of the plasma arc.

BACKGROUND OF THE INVENTION

Long arc plasma torches are commonly used in plasma chemistry and metallurgy, in plasma costing processes, plasma cutting and welding, and other industrial processes. Plasma torches are also used for vitrification of ceramics and hazardous wastes, in pyrolysis chambers, and in the processing of waste and generation of synthetic fuels. Plasma torches which can generate and deliver a high temperature stream of ionized gas need to meet several difficult requirements. One requirement is longevity of the electrodes, which have a surface region in direct contact with the plasma in a transient point known as the arc attachment. One problem of high energy plasma torches is that the high temperature arc attachment points at the electrode surface are proximal to very high temperatures of the reactive ionized gas, which can corrode the surface of the electrode at the arc attachment point. This surface corrosion subsequently leads to roughness of the electrode surface, which then causes enhanced electric fields in the corroded areas, which then encourages preferential plasma formation in the corroded areas. Another problem inherent in high energy long arc plasma torches is plasma arc initiation. In one prior art device, an external source introduces a plasma into the desired plasma arc extent, after which the ionized gas of the introduced plasma forms a plasma arc across the working electrodes of the plasma torch. In another prior art device, a separate transformer generates one or more areas of localized ionized gas along the path of desired plasma formation between the working electrode, which local plasmas combine upon application of sufficient voltage to the working electrodes. In either device, a separate plasma initiation structure is used at start-up time.

It is desired to provide a long arc plasma torch which self initializes and which provides improved electrode life by ensuring uniform wear of the electrode surface.

OBJECTS OF THE INVENTION

A first object of the invention is a plasma torch having a plurality of plasma tubes, each plasma tube having a plasma outlet tube including a plasma exit aperture, the plasma outlet tube including a shared plasma outlet which is electrically common to the other outlet plasma tubes, each plasma tube also having an electrically isolated central plasma tube and an electrode termination, the electrically isolated central plasma tube forming a first gap and plasma initiation region with the adjacent electrode termination and also a second gap plasma initiation region with the commonly connected plasma outlet tube, such that the application of a voltage across the electrodes with an ionizing gas directed to the plasma exit aperture causes a plasma to form in the first gap and also in the second gap and thereafter fully extend to span the electrodes of the plasma tubes, each electrode optionally having a series of apertures for the introduction of a gas having a circumferential velocity within the electrode for circumferentially rotating the plasma attachment point to the electrode, the electrode also having gas emitting apertures on at least one end of the electrode to provide for steering the arc attachment point axially over the extent of the electrode, the electrode surrounded by a coaxial coil for the generation of an axial magnetic field.

A second object of the invention is an arc attachment control system having a hollow cylindrical electrode carrying a plasma current and having a plasma arc attachment on an inner surface of the electrode, the electrode having a gas inlet port adjacent to a sealed window axially located on one end of the electrode and a plasma tube on the opposite side of the electrode, the sealed window coupling optical energy from the plasma arc attachment to an optical detector generating an electrical response which is inversely proportional to the distance from the arc attachment to the detector, the control system estimating the axial distance of the arc attachment to the electrode from the electrical response and thereafter regulating the flow of gas into the gas inlet port to provide for the arc spot uniformly traverse the axial extent of the electrode.

A third object of the invention is an arc attachment control system having a hollow cylindrical electrode carrying a plasma current and having a plasma arc attachment on an inner surface of the electrode, the electrode having apertures along the axial extent of the electrode and a series of optical detectors for determining the axial position of the arc attachment to the electrode, the electrode also having gas inlet ports adjacent to each ends of the electrode for the introduction of gas, the flow of gas at each electrode end regulated to place the arc attachment in a preferred location based on the arc attachment determined by the optical detectors, the flow of gas at each electrode regulated to ensure uniform electrode wear based on the estimated position of the arc attachment provided by the optical detectors.

A third object of the invention is a self-igniting plasma generator, the plasma generator having a plurality of plasma tubes, each plasma tube having an electrically common end leading to a plasma exit aperture adjacent to the plasma exit aperture of other plasma tubes, each plasma tube also having a conductive but electrically isolated center section and an electrode end having a hollow cylindrical electrode, the center section forming a first gap with the hollow cylindrical electrode on one end and a second gap with the common electrode on the opposite end, the electrode having a provision for introducing a gas adjacent to the electrode, where voltage applied to the electrodes of the plasma tubes causes the gas to ionize in each of the first and second gaps, the gas flow towards the exit apertures causing the plasma to expand in extent until the plasma is continuous between the electrodes.

SUMMARY OF THE INVENTION

The invention is a self-igniting plasma torch having a plurality of plasma tubes, each plasma tube having an electrode part having a hollow cylindrical electrode with an electrode gas port and closed window on a first end of the electrode and a first gap gas port on an opposite second end of the electrode, the first gap gas port formed by the gap between the second end of the hollow cylindrical electrode and an electrically conductive but isolated center plasma tube a first gap axial distance from the second end of the hollow cylindrical electrode and thereby forming the first gap, the center plasma tube having an opposite end which forms a second gap with an outlet plasma tube coupled to an exit aperture and electrically common with other outlet plasma tubes, each of which are coupled to a respective isolated center plasma tube having a respective first gap and second gap and terminating in a respective hollow cylindrical electrode. Each isolated center plasma tube which forms the first gap and second gap of each plasma tube is electrically isolated from other center plasma tubes and other hollow electrodes. In a plasma initiation mode, gas is introduced to each of the electrode gas ports, first gap ports and second gap ports, and a voltage is applied to each of the hollow cylindrical electrodes of each plasma tube. The applied voltage causes the gas at the first and second gaps to ionize, and the direction of gas flow causes the ionized plasma to flow to the exit aperture, where the plasma expands in extent across each first gap and second gap until the plasma is continuous and directly flowing from electrode to electrode through the plasma tubes. Gas which is introduced into the hollow cylindrical electrodes has an azimuthal velocity component, which causes the plasma arc attachment to rotate circumferentially within the hollow electrode. Additionally, a coil is in series with each hollow cylindrical electrode and surrounds the hollow cylindrical electrode to generate an axial magnetic field to each hollow electrode using the plasma current, and this magnetic field causes the plasma arc attach at the electrode surface to rotate circumferentially. An axial position control system measures optical energy at each of the electrode windows, or alternatively using a linear array of sensors which estimates attach position based on apertures in the hollow electrode, to estimate the axial arc attach position over the hollow electrode extent, and the gas flow to the electrode port and the first gap gas port is regulated to cause the plasma arc attach to uniformly move over the axial extent of the inner surface of the hollow electrode to provide uniform electrode surface wear. In addition to the axial position control provided by the regulation of gas introduction between the two ends of the hollow electrode, the gas which is introduced circumferentially into the hollow electrode in combination with the axial magnetic field generated by the coil provides uniform wear of the arc attach point of the inner surface of the hollow electrode.

DETAILED DESCRIPTION OF THE INVENTION

Figure 1:
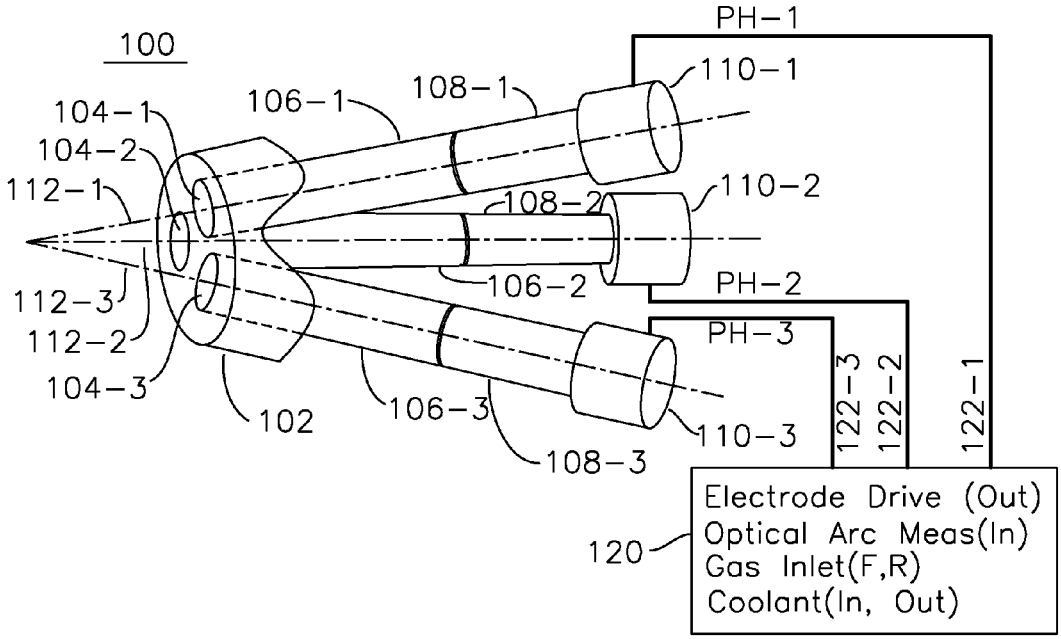
FIG. 1 shows a perspective drawing of a plasma torch.

FIG. 1 shows one example embodiment of a three phase plasma torch 100. The plasma torch has a plurality of plasma tubes equal in number to the number of electrical phases driving the electrode of each plasma tube, and each plasma tube has a local axis 112-1, 112-2, and 112-3. Each plasma tube consists of a plasma tube electrode unit 110-1, isolated plasma tube 108-1, and plasma outlet tube 106-1 which is electrically connected to other plasma outlet tubes with shared plasma outlet 102. The associated structure for this particular plasma tube indicated with a "–1" suffix, and the plasma tubes for other phases are correspondingly indicated with "–2" and "–3" suffixes. The plasma tube axis 112-1, 112-2, 112-3 are separated from each other by a solid angle with respect to a central axis (not shown), such that the plasma tubes are separated from each other in a plane normal to the central axis (not shown) by an angle of 360/n, where n is the number of phases and plasma tubes. In the three phase example of FIG. 1, the plasma tubes are separated from each other by 120 degrees circumferentially, and the angular separation from the central axis to the local axis of each plasma tube may vary from 5 to 30 degrees, as required by the application. As will be described in detail later, controller 120 has an electrode control part which provides drive voltage to each plasma tube electrode, and a gas control part which includes an optical arc measurement for estimating the temporal plasma arc attachment axial location in the electrode, a gas inlet and control for the multiple locations in each plasma tube where ionizing gas is introduced, and coolant for each electrode. The electrical, fluid, and gas interconnects from each plasma tube to controller 120 are shown for simplicity as single interconnects 122-1, 122-2, and 122-3.

The plasma generator may be used with any combination of ionizing and non-ionizing gases, including air, nitrogen, carbon dioxide, hydrogen, and noble and inert gasses. The plasma generator of the present invention is suitable for generation of high energy plasmas with arc lengths in excess of 0.3 m, such as arc voltages of 1 KV to 6 KV, any number of electrical phases (equal in number to the number of plasma tubes), and arc currents of 30 A to 500 A, resulting in high energy plasma in the range of 100 KW to 2500 KW.

Figure 2:
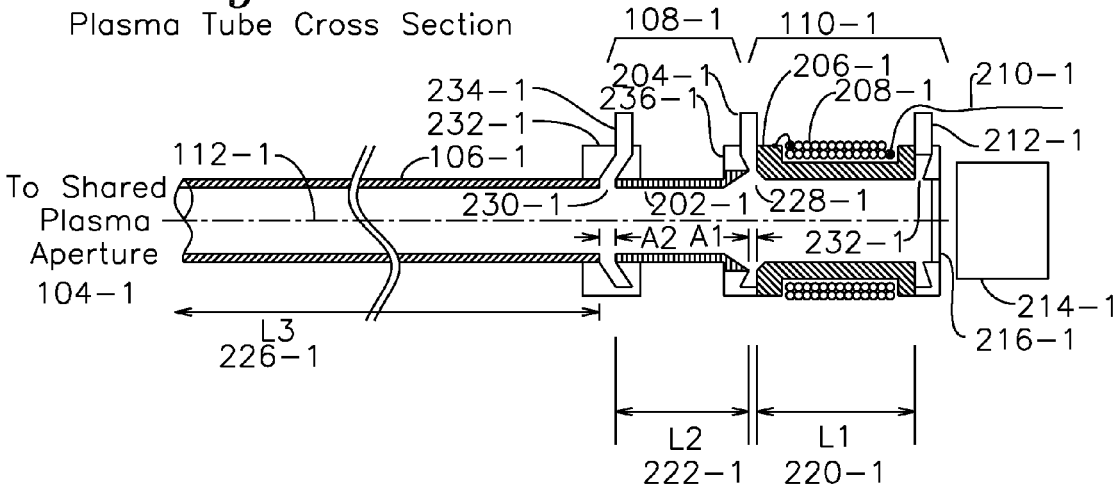
FIG. 2 shows a cross section view of a single plasma tube.

FIG. 2 shows a cross section diagram for one of the plasma tubes of FIG. 1. Plasma outlet tube 106-1 is centered about local axis 112-1 and leads to the shared plasma outlet 102 which terminates in plasma outlet aperture 104-1, which is joined electrically and mechanically to the other plasma outlet tubes 106-2 and 106-3. Adjacent to, and electrically isolated from plasma outlet tube 106-1, is isolated central plasma tube 108-1, which is also adjacent to and electrically isolated from plasma tube electrode termination 110-1. Plasma initiation first gap 228-1 with gap extent A1 and plasma initiation second gap 230-1 with gap extent A2 are on opposite ends of the isolated plasma tube 108-1, with first gap 228-1 formed by the gap between conductive hollow cylindrical electrode 206-1 and the conductive sleeve 202-1 of isolated plasma tube 108-1. Second gap 230-1 with gap extent A2 is formed by the gap between the electrically conductive isolated plasma tube 202-1 and electrically conductive plasma outlet tube 106-1. The hollow cylindrical electrodes 206-1 may be formed from any combination of copper, copper alloy, graphites, or formed from any conductor suitable for use in high temperature environments. Additionally, the hollow cylindrical electrodes 206-1 may include water cooling jackets (not shown) for heat removal such as with a coolant such as water, or the water cooling jacket may be isolated from the coolant using a suitable thermally conductive but electrically insulating dielectric material. The plasma outlet tube 106-1 and isolated plasma tube 108-1 may be formed from any electrically conductive material, including aluminum, copper, and copper alloys. As a rough guideline, for optimum outlet tube 106 and plasma tube 108 life, is preferred to use stainless steel for these components where the plasma current is less than 60 amps, and copper and copper alloys for currents above 60 A.

Also located in the first gap 228-1 is a first gap gas delivery structure 236-1 which includes gas inlet port 204-1, and structure 236-1 may optionally direct the inlet gas in a circular flow perpendicular to axis 112-1 to encourage a circumferential trajectory of the arc attachment about hollow cylindrical electrode 206-1. On the opposite end of hollow cylindrical electrode 206-1 is an electrode gas port 212-1 which includes a similar structure and inlet apertures 232-1 to encourage a circumferential trajectory of the gas introduced into the region of the hollow cylindrical electrode 206-1, with the introduced gas having a circular trajectory with the same sense as was provided by first gap gas delivery structure 236-1 through first gap 228-1. Controlling the relative gas flows between first gap 228-1 and electrode gap 232-1 allows axial control of the arc attachment point, and the measurement of axial arc attachment is performed with optical arc attachment estimator 214-1, which determines the attachment point through transparent window 216-1, which isolates the estimator 214-1 from the plasma and also encloses the gas and plasma volume, thereby directing the introduced gas to the exit aperture 104-1.

Voltage is applied to hollow cylindrical electrode 206-1 through lead 210-1, which passes first through helical wound coil 208-1, and the opposite end of the helically wound coil 208-1 which surrounds electrode 206-1 and is then electrically connected to the electrode 206-1, such that plasma current which passes through the electrode 206-1 self-generates an axial magnetic field parallel to local axis 112-1, which, along with the circumferential velocity of gasses introduced to the electrode, also encourages circumferential rotation of the arc attachment point across the inner surface of electrode 206-1. In this manner, the axial magnetic field generated by the plasma current causes circumferential movement of the arc attachment point, and differential control of gas flow through electrode gas inlet 212-1 and first gap gas inlet 204-1 provides axial steering of the arc attachment point over the inner surface of the hollow cylindrical electrode 206-1, with the differential gas flow rates determined from measurement of the axial arc position using optical measurement unit 214-1 through transparent circular window 216-1. Alternatively, axial arc attach position may be determined using a linear array of sensors which are positioned along the axial extent of electrode 106-1 and are optically coupled through apertures in the hollow electrode 206-1.

Second gap 230-1 also has a gas inlet port 234-1 which directs gas into the plasma tube using housing 232-1. The hollow electrode 206-1 has an axial extent L1 220-1, the isolated plasma tube 202-1 has an axial extent L2 222-1, and the plasma outlet tube 106-1 has an axial extent L3 from second gap 230-1 to outlet aperture 104-1 shown in FIG. 1. The extent of each of these three sections is selected in combination with first gap A1 and second gap A2 extents and operating voltage to provide for plasma initiation upon application of voltage to the hollow electrodes, as can be seen in FIG. 3A for two electrodes.

Figure 3A:
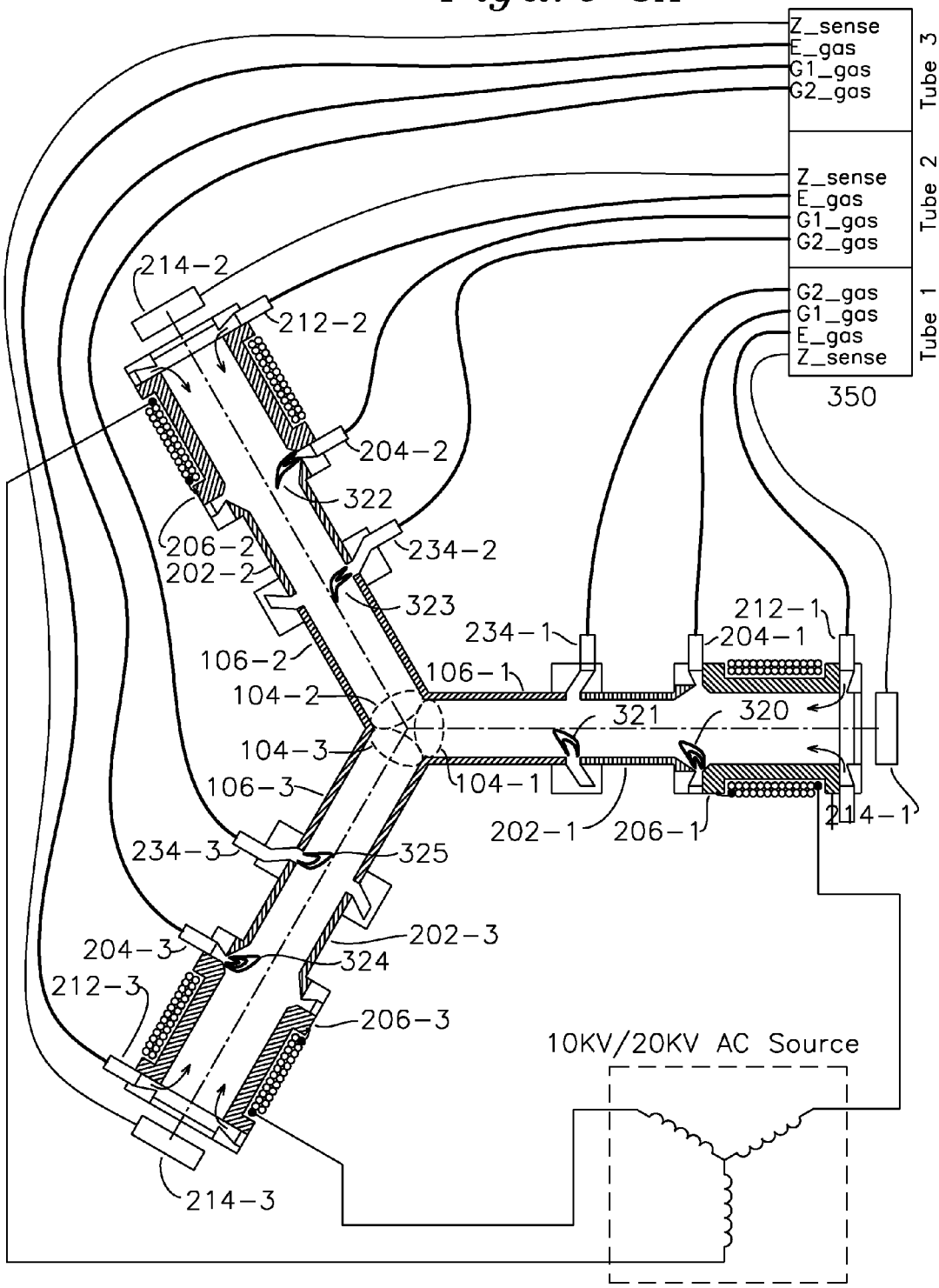
FIGS. 3A, 3B, and 3C show a composite cross section view of a three phase plasma torch in a first stage, second stage, and final stage, respectively, of plasma initiation.

In a first interval of plasma initiation shown in FIG. 3A, a voltage such as three phase voltage in the example range of 10 kV to 20 kV is applied across annular electrodes 206-1, 206-2, and 206-3 while ionizing gas is introduced in the three ports (electrode gas port 212-1, first gap gas port 204-1, and second gap gas port 234-1) of each plasma tube. If the first gap extent A1 (shown in FIG. 2 as 228-1) of each plasma tube is shorter than second gap extent 230-1 A2, the electric field density will be highest at the first gap extent, resulting in the ionization of gas and subsequent formation of initial plasma 320, 322, 324, followed almost instantaneously by initial plasma formation 321, 323, 325, as shown in the first gap and second gap regions, respectively, of the three plasma tubes. The initial plasmas formed across the first gap and second gap of each plasma tube spread along the conductive walls or electrode surface of the respective axial extents of each plasma tube, as shown in first gap regions 330, 332, 334 arc extent from electrode to isolated plasma tube wall and second gap regions 336, 338, and 340 from isolated plasma tube wall to shared plasma outlet tubes of FIG. 3B, and each of the plasmas grows in lateral extent and also in the direction of the plasma outlet tube exit apertures 104-1, 104-2, 104-3 (shown for reference in this composite cross section view) with the introduction of pressurized gas in the electrode gap, first gap, and second gap regions. As the extent of the plasmas grows and follows the gas to the exit apertures, the plasma regions between electrodes interconnect and interact until each electrode has a single plasma path interconnecting each of the electrodes of the respective plasma tubes, as shown in FIG. 3C plasma 340, 342, 344, and the plasma longer has attachment points to the conductive isolated plasma tubes 202-1, 202-2, or 202-3 or to the shared plasma outlet plasma tubes 106-1, 106-2, or 106-3. At this point, the plasma is now flowing directly between electrodes 206-1, 206-2, and 206-3 and is entirely contained within the plasma tubes and directed to the exit apertures, with no remaining plasma in the first and second gap regions. The plasma torch has now completed plasma initiation and enters a steady state operational mode.

FIG. 3C also shows the gas controller 350 component of the controller 120 of FIG. 1. Gas controller 350 includes an axial arc attachment sensor 214-1, 214-2, 214-3 and associated control valves (not shown) which regulate the flow of gas to the electrode gas port 212-1, first gap gas port 204-1, and second gap gas port 234-1 based on the arc attachment local axial (Z) position, which position is modulated cyclically from front to rear of the hollow cylindrical electrode by regulation of the ratio of gas flows into the electrode gas port on the rear of the electrode and first gap gas line port on the front of the electrode to minimize the single point surface wear. Successful control of the axial arc attach position and circumferential rotation rate of the arc attach can provide a large increase in electrode usable life in the range of thousands of hours of life. The arc attachment control for each plasma tube operates independently of the arc attach control of the other plasma tubes.

Figure 4:
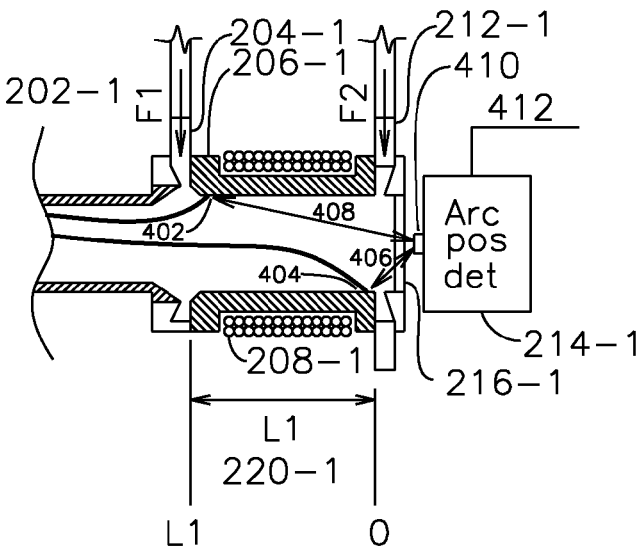
FIG. 4 shows the cross section view of an electrode with a plasma arc and arc axial position detector.
Figure 5:
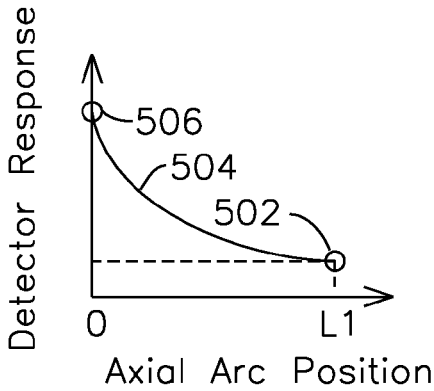
FIG. 5 shows a plot of the response of the detector of FIG. 4.

FIGS. 4 and 5 show one example embodiment for a sensor system estimating the arc axial position. Arc axial positional estimator 214-1 may use an omni-directional optical sensor 410 which is responsive to the intensity of the arc, such that when the near field arc intensity is used as a calibration point, the separation distance may be computed using the detector output and the inverse square law which estimates intensity at a distance, in combination with the near field arc intensity measurement. The arc attachment point 404 rotates circumferentially over the inside surface of electrode 206-1 at a particular distance 406, with a high rate of circumferential rotation compared to axial movement, so that as the arc spot 404 rotates, the fixed circumferential distance 406 to detector 410 produces a relatively fixed detector response at output 412. The detector response for arc spot 404 is shown in 506 of FIG. 5, with the distance response shown with the inverse square response plot 504, such that an arc attachment at point 402, which is a separation distance 408 from detector 410 produces the response shown in point 502. Window 216-1 provides optical coupling from detector 410 to resolve the range of arc spot attachment from 402 to 404 while providing mechanical and electrical isolation of the detector from the ionized gas and plasma arc. Detector 410 may be operative in the infrared, visible, or ultraviolet wavelengths, and window 216-1 may be constructed of a material with matching wavelength characteristics.

One of the advantages of the present invention is the independent control of arc attachment axial position, which is controlled by the ratio of F2 to total flow Ft=F1+F2 and control of the arc attachment circumferential rotation, which is primarily controlled by the azimuthal velocity component of the gas jets F1 and F2 at the hollow electrode in combination with the magnetic field generated by the coil which surrounds the electrode. It is desired to be able to control these independent arc position parameters to prevent excessive heat buildup on an electrode from a stationary arc spot attachment, which would otherwise cause destruction of the electrode surface.

Figure 6:
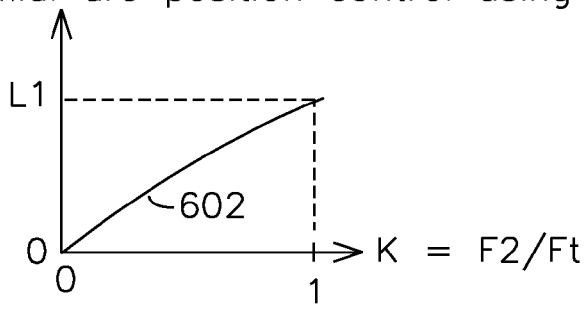
FIG. 6 shows a plot of the axial arc position versus flow F2.

In one example embodiment of the invention, a flow of gas at a substantially fixed flow rate Ft is divided between the front gas port 204-1 and rear gas port 212-1 of the electrode. In this embodiment, the total flow of gas is Ft (Ft=F1+F2), where F1 and F2 are shown in FIG. 4 and the fraction of gas applied to the rear gas port of the electrode may be expressed as F2=K*Ft (0≤K≤1). FIG. 6 shows a plot for axial control of the arc attachment point using the configuration of FIG. 4. As was described in FIG. 2, electrode gas port 212-1 (shown with flow rate F2) and first gap gas port 204-1 (shown with flow rate F1) both support controllable gas flows, with the gas flow F2 of electrode port 212-1 passing over the surface of electrode 206-1, and where the axial position of the circumferentially rotating arc attach can be entirely controlled by the ratio of gas flows for F1 and F2. In this manner, the circumferential arc attachment can be varied from 0 (arc attachment 404) to L1 (arc attachment 402) through control of flows F2 and F1 at port 212-1 and 204-1, respectively. This is illustrated in plot 602 of FIG. 6, which shows that as flow F2 is increased from 0 to the maximum flow rate $F_t$, the axial position of the arc attachment point can be varied from 0 to L1.

In one "open loop arc attachment control" embodiment of the invention, the required flow rates F1 and F2 (or alternatively the required values of K for a particular Ft) are determined which provide control of the plasma arc attach position over the range 0-L for a particular electrode configuration. Once these parameters are known, it is possible to simply vary F1 and F2 (or K) in a cyclical manner to ensure sufficient arc attachment circumferential rotation and axial movement, which would thereby eliminate the need for the arc position detector 214-1 of FIG. 4.

Independent from the axial position control, the circumferential rotation of the arc attachment (for a fixed axial position) can be controlled by the circumferential velocity components of the gas flows F1 and F2 entering the electrode, in addition to the J×B magnetic field generated by the coil surrounding the electrode. In the embodiment of the invention shown in FIGS. 4 and 7, the magnetic field generated by coil 208-1 (which carries the electrode 206-1 feed current) interacts with the plasma to cause a J×B axial rotational force which is proportional to gas flow.

Figure 7:
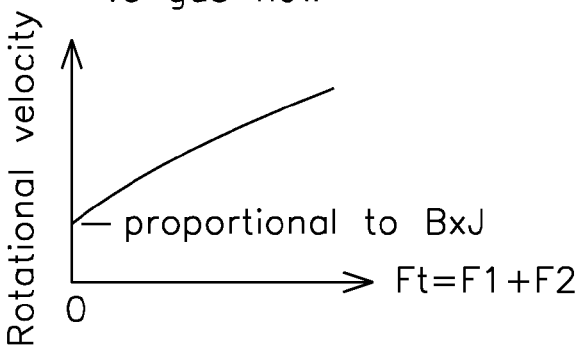
FIG. 7 shows a plot of arc attach angular velocity versus gas flows.

In one embodiment of the invention, flow-directing vanes may be present in the structures associated with electrode gap 232-1 of FIG. 2 and first gap 228-1 (and optionally electrode 206-1) which causes the gas entering ports 212-1 and 204-1, respectively, to have a circumferential velocity in the same direction as the smaller circumferential velocity generated by the J×B field within the electrode, and these two forces together contribute to the circumferential rotation of the arc attachment spot on the inner surface of the electrode. Where such structure which cause circular rotation of the gas are present, the circumferential rotational velocity of the arc attachment spot may be controlled, as shown in FIG. 7, by the combined flow F1 and F2 which enters the electrode port and first gap port.

In one embodiment of the invention, 10% to 50% of the gas flow through a particular plasma tube enters through the first gap gas port and electrode gas port (for control of the arc attach axial position), and in another embodiment of the invention, the second gap gas port is responsible for 50% to 90% of the gas flow in a plasma tube.

The number of turns on coil 208-1 of FIG. 2 which is in series with the electrode lead 210-1 are chosen to provide a magnetic field strength sufficient to ensure optimum plasma coherency, which provides for a high current and high temperature plasma, while also providing minimal wear to the surface of the hollow cylindrical electrode 206-1. As current density and electrode wear are competing parameters, a tradeoff is made between these two objectives in the selection of the coil. Since the gas entry at electrode gap 232-1 and first gap 228-1 provides circumferential velocity, it is also possible in one embodiment of the invention to control plasma rotational velocity using gas pressure alone. In another embodiment of the invention, the plasma circumferential rotation is achieved using the interaction between the magnetic field generated by coil 208-1 and the self-current of the plasma at the arc attach point, and in another embodiment of the invention, the magnetic field of the coil, the self-current of the plasma, and the circumferential velocity of the gas provide rotation of the plasma arc spot attachment to the electrode 206-1.

Figure 8:
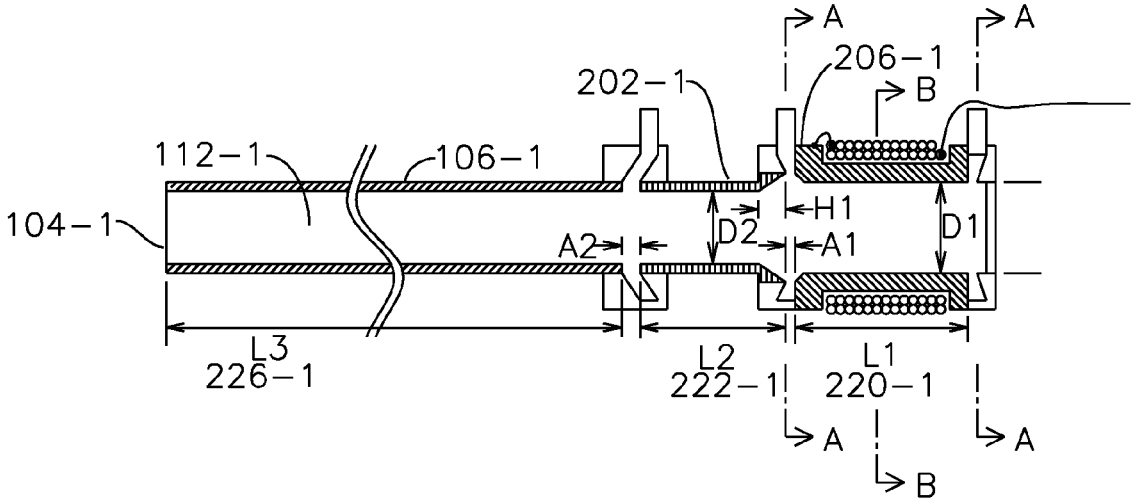
FIG. 8 shows a cross section diagram of a plasma tube indicating dimensional relationships.

FIG. 8 identifies particular structures with dimensional notations provided, and in one embodiment of the invention, the following preferred dimensional relationships may be used:

D1—inner diameter of the hollow cylindrical electrode, selected on the basis of electrode life, current density, and heat dissipation (in the range 20-200 mm in one embodiment);

L1—hollow electrode length, in the range of 2*D1 to 10*D1;

L2—isolated plasma tube electrode length, in the range of 5*D1 to 30*D1;

D2—isolated plasma tube electrode inner diameter, in the range of 0.5*D1 to D1;

H1—in the case where a vortex is used (where the intermediate tube has a diameter D2 less than hollow electrode diameter D1) H1 may be in the range of 20 mm-300 mm;

L3—plasma outlet tube length, in the range of 5*D1 to 40*D1;

A1—first gap extent in the range 1 mm to 10 mm;

A2—second gap extent in the range of 1 mm to 10 mm.

Figure 9:
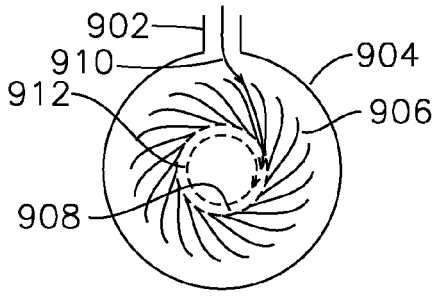
FIG. 9 shows a cross section diagram of a gas inlet port adjacent to an electrode.

FIG. 9 shows a cross section diagram of the gas inlet structures adjacent to the hollow electrode, such as through section A-A of FIG. 8. Each gas inlet admits a gas through an inlet port 902, where it encounters a series of vane structure 906 or other structures which direct the flow of the gas in a tangential circumferential flow 912, as shown by flow trajectory 910. In a preferred embodiment, the vanes 906 terminate outside the extent 908 of the hollow electrode so as to not interfere with plasma initiation or generation, and the vanes 906 may be fabricated from an insulating material to avoid interference with the plasma initiation.

In one alternative embodiment of the plasma generator, the individual outlet apertures of the shared plasma outlet are collected together into a single plasma port for transfer and delivery of the generated plasma. In another embodiment of the invention, the electrodes are coupled to a voltage source which provides alternating current (AC), or the electrodes are coupled to a coil wound around the hollow electrode, or to an alternating current voltage source with series inductors which limit the plasma current, or any combination of these. Additionally, the example shown may be adapted to operate on any number of electrical phases, although three phases is shown.

In other example embodiments for a single phase application, there may be two plasma tubes, or alternatively, four plasma tubes may be connected with same-phase electrodes adjacent to each other and with 90 degree separation from a common central axis.

Figure 3B:
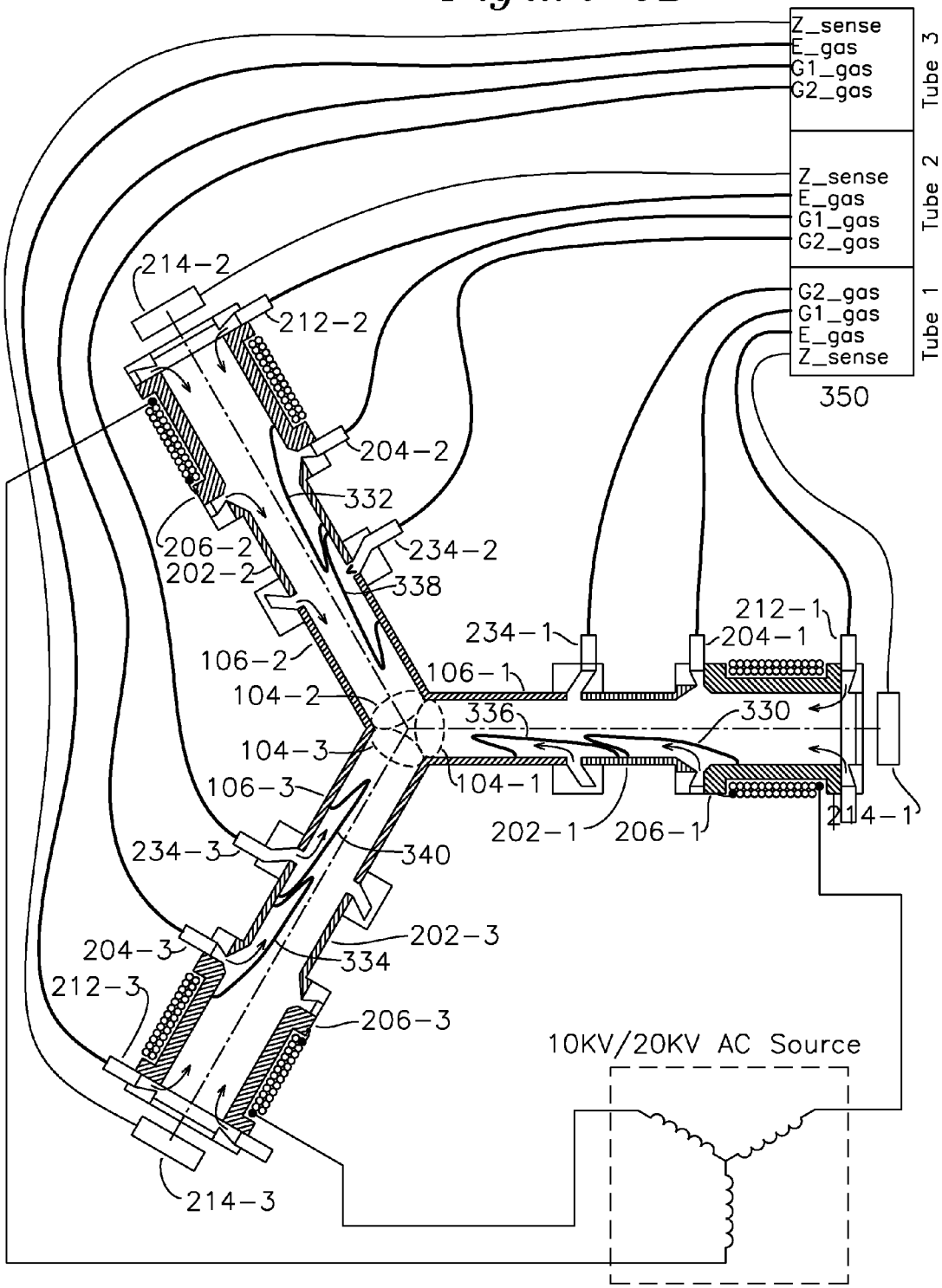
Figure 3C:
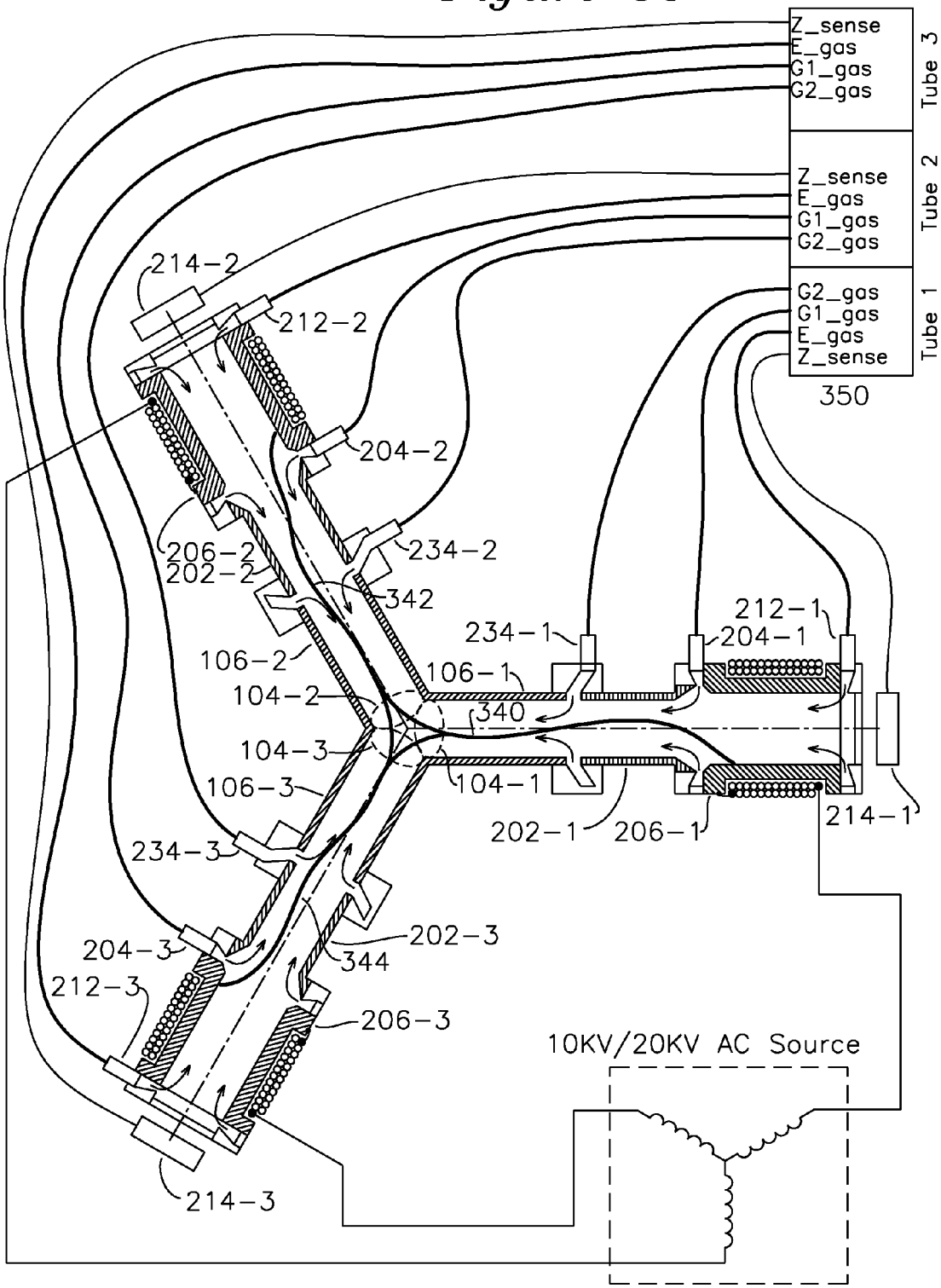

Additionally, the controller 350 of FIGS. 3A, 3B, and 3C or the controller 120 of FIG. 1 may estimate axial position of the arc attachment using an optical sensor, or it may regulate gas flows such as F1 and F2 of FIG. 4 (G1_gas and E_gas, respectively, in FIGS. 3A, 3B, and 3C) for axial control based on device characteristics in combination with the measurement of current and voltage applied to each electrode, where the characterization also indicates the amount of F1 and F2 gas flows required for satisfactory operation and axial movement to achieve uniform electrode wear. Similarly, the measurements of electrode voltage and current may be used to regulate the flows of E_gas, G1_gas, and G2_gas shown in FIGS. 3A, 3B, and 3C.

We claim:

1. A plasma torch comprising:

an outlet aperture formed by a plurality of plasma outlet tubes which join to form a plurality of plasma outlets;

a plurality of isolated plasma tubes, each having a first gap end and a second gap end;

a plurality of hollow electrodes, each placed a first gap distance from an associated end of said isolated plasma tube first gap end, thereby forming a first gap;

each said isolated plasma tube second gap end placed a second gap distance from an associated said plasma outlet tube, thereby forming a second gap;

each said hollow electrode having a first gap gas inlet surrounding said first gap, an electrode gas inlet on the opposite end of said hollow electrode, and a second gap gas inlet surrounding said second gap;

a plasma gas which enters said electrode gas inlet, said first gap gas inlet, and said second gap gas inlet;

at least two said hollow electrodes energized with a voltage from a voltage source sufficient to ionize said plasma gas.

2. The plasma torch of claim 1 where said voltage is a three phase voltage and the number of said plurality of hollow electrodes and said plasma tubes is three.

3. The plasma torch of claim 1 where said first gap distance and said second gap distance are selected to initially ionize said plasma gas across said first gap and said second gap, the plasma thereafter flowing directly from one said hollow electrode to another said hollow electrode.

4. The plasma torch of claim 1 where said electrode gas inlet and said first gap gas inlet have a plurality of vanes to cause circumferential gas flow across the inner surface of said hollow electrode.

5. The plasma torch of claim 1 where at least one of said electrode gas inlet or said first gap gas inlet generates a circumferential gas flow adjacent to said hollow electrode.

6. The plasma torch of claim 1 where said hollow electrode includes a coil wound around the outer diameter of said hollow electrode, said coil generating a substantially axial magnetic field.

7. The plasma torch of claim 1 where said hollow electrode includes a coil wound around the outer diameter of said hollow electrode, said coil in series with said voltage source and said electrode.

8. The plasma torch of claim 1 where said voltage source is a three phase alternating current (AC) voltage source.

9. The plasma torch of claim 1 where said voltage source is current limited by a series inductance.

10. The plasma torch of claim 1 where said electrode gas inlet includes an adjacent transparent aperture for the examination of the axial location of a plasma arc attachment within said hollow electrode, and the flow of gas into said electrode gas inlet and said first gap gas inlet is controlled to cyclically move an arc attachment point over the axial extent of said hollow electrode.

11. A plasma torch having:

a plurality of hollow electrodes, each said hollow electrode having an electrode gas inlet port and a first gap gas inlet port on the opposite end from said electrode gas inlet port;

a plurality of isolated plasma tubes, each said isolated plasma tube placed a first gap distance from said hollow electrode, thereby forming a first gap having a first gap plasma initiation region, each said isolated plasma tube having a second gap end opposite said first gap plasma initiation region;

a plurality of electrically connected plasma tubes, each said electrically connected plasma tube placed a second gap distance from an associated isolated plasma tube second gap end, thereby forming a second gap having a second gap plasma initiation region, the opposite end of said electrically connected plasma tubes having a plasma outlet aperture which is adjacent to other electrically connected plasma tubes and thereby forming a plasma outlet;

whereby upon the application of a gas to said electrode gas inlet, said first gas inlet, and said second gas inlet, and the application of an electrical voltage to said electrodes, said first plasma initiation region and said second plasma initiation region form localized plasmas across said first gap and said second gap which join to form a single plasma across said hollow electrodes.

12. The plasma torch of claim 11 where said electrode gas inlet and said first gas inlet have respective gas flows which are cyclically varied.

13. The plasma torch of claim 11 where said electrode has a plurality of tangentially formed apertures which cause the circumferential flow of said plasma gas.

14. The plasma torch of claim 11 where said gas includes an ionizing or non-ionizing gas.

15. The plasma torch of claim 11 where said gas includes at least one of nitrogen, carbon dioxide, hydrogen, noble, or an inert gas.

16. The plasma torch of claim 11 where said hollow electrode includes a co-axially wound coil which is in series with said electrode and said voltage source for said electrode.

17. The plasma torch of claim 11 where said electrode gas inlet and said first gap gas inlet are fed with gasses having a flow rate which is controlled based on axial arc attachment position within an associated electrode.

18. The plasma torch of claim 11 where said electrode gas inlet and said first gap gas inlet are fed with substantially constant gas flow rate which is cyclically varied proportionally between said electrode gas inlet and said first gap gas inlet sufficient to move an arc attachment location axially over said electrode surface.

19. The plasma torch of claim 11 where said source of electrical voltage is a three phase alternating current (AC) voltage.

20. The plasma torch of claim 19 where said source of electrical voltage is current limited by a series inductor.

* * * * *